United States Patent [19]

Choate

[11] 4,240,399

[45] Dec. 23, 1980

[54] LOG-BURNING STOVE

[76] Inventor: James R. Choate, 2409 Sampson Rd., Rochester, N.H. 03067

[21] Appl. No.: 962,042

[22] Filed: Nov. 20, 1978

Related U.S. Application Data

[63] Continuation-in-part of Ser. No. 789,517, Apr. 21, 1977, Pat. No. 4,131,104.

[51] Int. Cl.[3] ..... F24C 1/00; F24B 7/00

[52] U.S. Cl. ..... 126/58; 126/123; 126/126

[58] Field of Search ..... 126/59, 58, 123, 126, 126/3, 4, 192, 224, 11, 226; 110/235; 220/72, 71

[56] References Cited

U.S. PATENT DOCUMENTS

| | | | |
|---|---|---|---|
| 656,404 | 8/1900 | Harris | 126/224 |
| 1,715,683 | 6/1929 | Stevens | 220/72 |
| 2,036,276 | 4/1936 | Hotherssall | 220/72 |
| 2,403,941 | 7/1946 | McLaren | 126/11 |
| 3,199,503 | 8/1965 | Hanson | 126/126 |
| 4,117,824 | 10/1978 | McIntire et al. | 126/4 |
| 4,141,336 | 2/1979 | Fitch | 126/126 |

*Primary Examiner*—Samuel Scott
*Assistant Examiner*—Wesley S. Ratliff, Jr.

[57] ABSTRACT

A log-burning stove which includes a door having a plurality of parallel, fixed, guide-rail elements disposed on the inside of the door and in the plane of the door, the guide-rail elements parallel to the combustion-chamber entrance of the stove and adapted to permit a heavy log to be slid into position adjacent the stove entrance on the upper surface of the guide-rail elements.

8 Claims, 4 Drawing Figures

LOG-BURNING STOVE

REFERENCE TO PRIOR APPLICATION

This application is a continuation-in-part of U.S. Ser. No. 789,517, filed Apr. 21, 1977 (now U.S. Pat. No. 4,131,104, issued Dec. 26, 1978), hereby incorporated by reference in its entirety.

BACKGROUND OF THE INVENTION

Wood stoves, particularly log-burning stoves of antique and current design, are often quite unsatisfactory for the loading and burning of heavy logs. Such stoves often accommodate only logs of small or less than economical size, and such stoves, even if large enough to accept heavy, full-length logs, often do not provide provisions for the easy loading and inserting of the logs into the combustion chamber of the stove.

In my copending U.S. patent application Ser. No. 789,517, filed Apr. 21, 1977 (now U.S. Pat. No. 4,131,104), there is described an improved log-burning stove wherein a log-loading door to the stove is provided to permit the easy introduction of logs into the combustion chamber of the stove. The stove door is adapted to move between a closed, upright, sealed position and an open, supporting position extending generally laterally from the lower portion of the combustion-chamber opening. The stove door contains thereon a plurality of spaced-apart, freely rotatable rollers, with each roller disposed for rotation on a fixed axis element, with the ends of the axis element supported on the interior of the door and with the rollers disposed on a plane generally parallel to the door and the axis of the rollers generally perpendicular to the entrance of the combustion chamber when the door is placed in the open position. When the stove door is in the fully open position, a log, placed on the plurality of rollers, is easily moved parallel to the entrance of the stove and to a position adjacent to the combustion-chamber entrance, and, thereafter, by raising the door from the opened to the closed position, the logs so positioned are moved through the log-burning-stove entrance and into the combustion chamber.

The present invention is directed to a further improvement of the log-burning stove with the door as described and claimed in my parent application.

SUMMARY OF THE INVENTION

My invention is directed to a log-burning stove which provides for the easy loading or positioning of large, economical, heavy logs and the introduction of such logs so positioned into the combustion chamber of the stove. In addition my invention is directed to a log-burning stove containing an improved stove door which permits the easy loading of logs into the combustion chamber of the stove and which also provides for a log-burning stove with an improved draft-control structure and means between the log-burning door and the draft control which extends across the substantial length of the combustion chamber of the stove below the lower lid of the door.

My improved log-burning stove includes a shell defining a combustion chamber for the combustion of logs or other materials; a flue for the discharge of the gaseous combustion products derived from the combustion of the material in the combustion chamber; an entrance in one wall of the stove shell to the combustion chamber for the introduction of combustion material; a door adapted to be placed in an opened or a closed position and generally extending, in the preferred embodiment, the full length of one side of the shell, and which door, in the closed upright position, seals the entrance into the combustion chamber, and which, in the opened position, generally extends laterally outwardly adjacent to and from the lower bottom edge of the entrance; means to provide for the movement of the door between the opened and closed positions and to retain the door in the opened and closed positions as required; and means positioned on the internal surface of the door to permit the movement of logs or other combustible material on the surface of such means when the door is in the opened position, which means comprises a plurality of longitudinal guide-rail elements disposed generally parallel to each other and to the entrance into the combustion chamber, the guide-rail elements so positioned that logs placed thereon may be slid smoothly on the upper surface of the rail elements to a position adjacent the entrance into the shell of the stove.

I have found that the longitudinal guide-rail elements should be positioned generally parallel and spaced apart from each other generally greater than a distance of about 4 inches, to represent the minimum diameter of a heavy log. A log of lesser diameter would be handled easily and inserted directly by conventional means. I have found that my improved log-burning stove represents an improvement in that the plurality of guide-rail elements also forms reinforcing ribs that strengthen the stove door. They are simple in structure and lend themselves to the manufacture of the stove door in cast iron. In view of the lack of moving parts, there is no clogging of the guide rails which might occur with the rollers of my previous door, due to fire residue or warping from the intense heat of the fire of the combustion chamber.

In addition, I have found that, in the preferred embodiment, only two longitudinal guide rails may be employed in the simplest embodiment, and that, further, two additional upper and lower guide rails or braces may be employed, the upper brace element serving as a brace and draft deflector for the elongated draft means and opening underneath the lower edge of the door, as described in my previous application, while the upper door brace, as before, acts to form a seal against the gasket on the upper entrance of the stove. In particular, I have found that the use of a lower brace/draft-deflector element permits the draft-control air entering the elongated draft-control slot to be angled inwardly and downwardly into the combustion chamber to promote better combustion when the door is in the closed position.

Thus my improved log-burning stove provides an improvement in the ease, cost and simplicity of manufacturing the log-loading door and the control of the draft air into the combustion chamber. My improved log-burning stove will be described and illustrated in regards to a preferred embodiment which is directed to the combustion of large logs. However, it is recognized, by those persons skilled in the art, that various changes and modifications may be made in the preferred embodiment of my log-burning stove, as described and illustrated, and in its operation, without departing from the spirit and scope of my invention.

DESCRIPTION OF THE EMBODIMENTS

Figure 1:
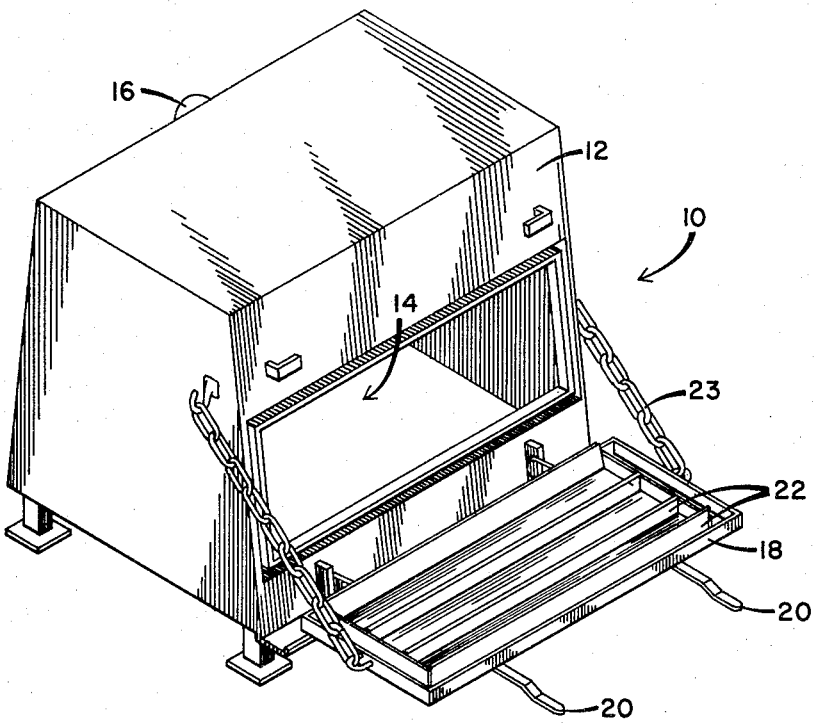
FIG. 1 is a perspective view of my stove, with the improved loading door in an open position.

My log-burning stove 10 comprises a generally steel outer shell which defines a combustion chamber therein, which combustion chamber may be lined as desired with refractory material, the shell including a front wall 12 and a combustion chamber entrance 14 in the front wall and including a flue 16 for the discharge of combustible products and a log-loading door 18 illustrated in the opened log-receiving position. The door includes a pair of elongated door handles 20 which may be employed to raise the door 18 into the closed position, with the handles to be adapted to be fastened hingedly to the upper part of the front wall 12, so as to retain the door in a closed position. The door 18 is shown being retained in an opened position through support chains 23 extending from the front wall 12 of the stove 10 and with two guide-rail elements 22 shown.

Figure 2:
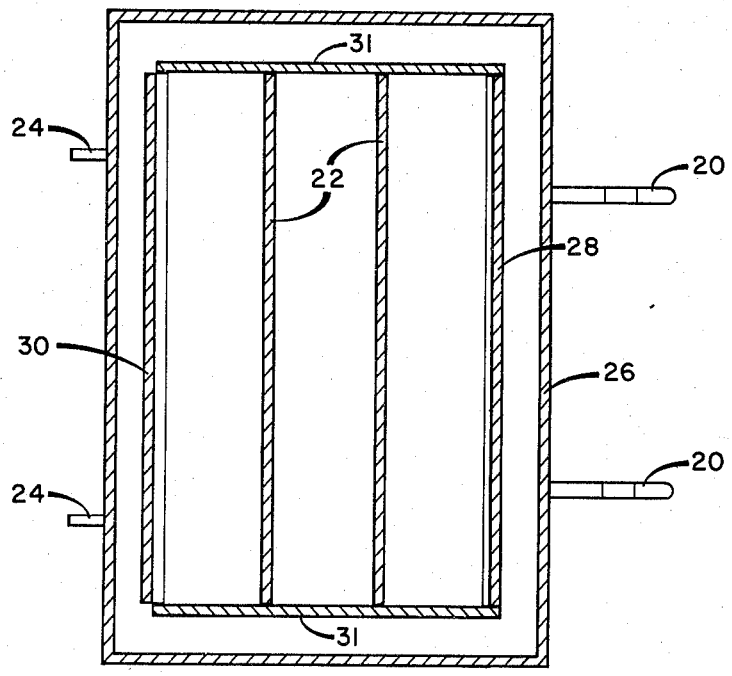
FIG. 2 is a top plan view of the log-loading door of my log-burning stove.
Figure 3:
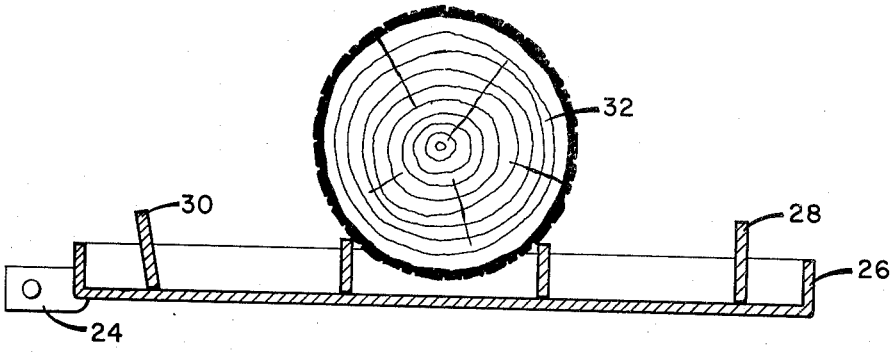
FIG. 3 is a representative cross-sectional view of my stove door.

FIGS. 2 and 3 illustrate my improved door in more detail wherein the door is secured through a pair of hinges 24 to the front wall 12 of the stove 10. The door includes an outer steel-door frame 26, the door being in generally rectangular shape. My door includes an upper steel-door brace 28, a lower angled steel-door brace and air deflector 30 and guide rails 22, with end brace elements 31 at each end. The brace elements 28 and 30 and rail elements 22 may be secured by welding, or the entire door thereof may be made of cast iron and cast in place. The spaces between the end plates 31, the brace 28 and air deflector 30 are disposed for gasket-sealed engagement against the front wall 12 of the stove 10 and about the combustion entrance 14 to place the door in a closed, sealed position.

As illustrated more particularly in FIG. 3, there is shown in log 32 having a diameter of greater than about 4 inches placed in the surface of the guide-rail elements 22. In one embodiment, the guide rails 22 would be positioned about 4 inches apart, centrally disposed apart on either side on the center line of the door, with the guide rails being about $1\frac{1}{2}$ inches in height and $\frac{1}{4}$ inch in thickness, with the end braces 30 being $1\frac{1}{4}$ inches in height and $\frac{1}{4}$ inch in thickness, while the draft/deflector element 30 would be the same or slightly greater; that is, 2 to $3\frac{1}{2}$ inches in height.

In operation, a heavy log is moved generally end over end to the side of the door 18, lifted onto the door and then slid parallel to the combustion chamber entrance 14 on the upper surface of the guide rails 22, until the log is in the desired position adjacent to the combustion-chamber entrance. Thereafter, the door, then in the opened position, is placed in the closed position through the upward movement of the door handles 20 to discharge the log into the combustion chamber.

Figure 4:
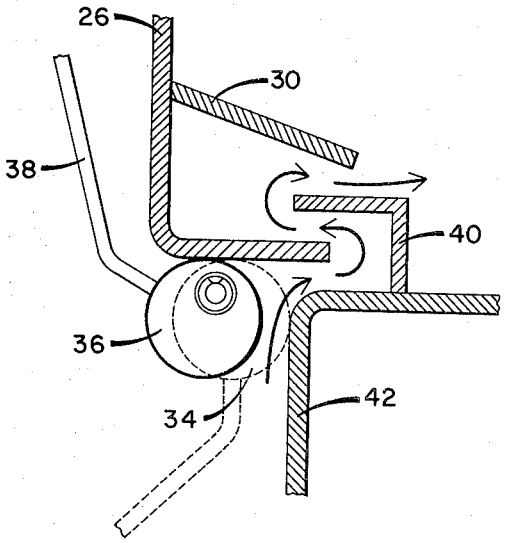
FIG. 4 is an enlarged, partially cross-sectional, fragmentary view of the door in a closed position, with the draft-control means and improved draft deflector of the door illustrated.

My improved log-burning stove, as shown in FIG. 4 and described more fully in my parent application, has an elongated, slotted, air-draft opening 34 which extends generally the length of the door 18 just below the lower part of the door 18 and includes a draft-control means, whereby the flow of air is controlled through the elongated, slotted, draft opening 34. A draft-control means is used which comprises an eccentric rod element 36 and a rod handle 38 which moves the rod element 36 between an opened position, as illustrated, where air enters the combustion chamber, as shown by the directional arrows, and a closed position, as shown in dotted lines, wherein draft air is prevented from entering the draft opening 34. An angled extension of the bottom seal channel 40 of the stove 10 is shown on the lower front wall of the stove, with the brace/air deflector 30 shown when the door is in the closed position. In operation and as shown in the closed position, the draft-control means is open and the air entering the draft-control opening 34 and passing through the opening and about the angle extension 40 is deflected downwardly by the lower surface of the draft deflector 30 and into the lower portion of the combustion chamber, to aid in the combustion of the logs therein. My improved stove door permits the easy loading of logs into the combustion chamber and provides a means for deflecting the draft air incorporated into the door structure.

What I claim is:

1. A log-burning stove which comprises:

(a) a shell defining a combustion chamber for the combustion of logs;

(b) a flue for the discharge of gaseous combustion products derived from the combustion of the logs;

(c) an entrance in one wall of the shell and into the combustion chamber for the introduction of logs into the combustion chamber;

(d) a door having a peripheral frame structure and adapted to be placed in an opened or a closed position, and which door, in the closed upright position, seals the entrance of the combustion chamber, and which door, in the opened position, extends generally laterally outwardly adjacent to and from the lower bottom edge of the entrance of the combustion chamber;

(e) means to provide for the movement of the door between an opened and a closed position; and (f) the improvement which comprises means to permit placement and support of a log on the door prior to entry into the combustion chamber, which means comprises (i) a plurality of generally parallel, spaced-apart, fixed, thin, raised, guide-rail elements, the guide-rail elements in the upper surface and extending slightly above the inner surface of the plane of the door and the peripheral frame structure and positioned and spaced apart, so as to support between the guide-rail elements a log on the upper surface of the guide-rail elements, (ii) the thin guide-rail elements secured to the inner surface of the door, (iii) end brace elements extending generally perpendicular to the guide-rail elements, the end brace elements having an upper surface not greater than the upper surface of the guide-rail elements, the end brace elements adjacent to the ends of the guide-rail elements, to form with the upper and lower guide-rail elements an inner frame structure within, spaced apart from and of the general shape of the peripheral frame structure of the door, and (iv) the guide-rail elements having a log-slidable upper surface adapted to permit a log to be slid on the upper surface of the elements and generally parallel to the entrance to the combustion chamber, so as to position the log in a desired position for entry into the combustion chamber, and whereby, on placing the door in the upright closed position, the positioned log on the guide-rail elements is disposed into the combustion chamber of the stove.

2. The stove of claim 1 wherein the guide-rail elements comprise two guide-rail elements extending generally parallel and substantially the length of the door and spaced apart a distance of 4 inches or greater, and which includes door-brace elements generally parallel to the guide-rail elements and attached to the inner surface of the door at the top thereof, the brace elements having an upper surface raised above the upper surface of the guide-rail elements.

3. A log-burning stove which comprises:

(a) a shell defining a combustion chamber for the combustion of logs;

(b) a flue for the discharge of gaseous combustion products derived from the combustion of the logs;

(c) an entrance in one wall of the shell and into the combustion chamber for the introduction of logs into the combustion chamber;

(d) a door having a peripheral frame structure and adapted to be placed in an opened or a closed position, and which door, in the closed upright position, seals the entrance of the combustion chamber, and which door, in the opened position, extends generally laterally outwardly adjacent to and from the lower bottom edge of the entrance of the combustion chamber;

(e) means to provide for the movement of the door between an opened and a closed position; and (f) the improvement which comprises (i) an elongated, slotted, draft opening disposed in the front wall of the stove and just below and adjacent the lower edge of the door and extending substantially the length of the door, (ii) means to permit placement and support of a log on the door prior to entry into the combustion chamber, which means comprises a plurality of generally parallel, spaced-apart, fixed, guide-rail elements, the guide-rail elements in and extending slightly above the inner surface of the plane of the door and the peripheral frame structure and positioned and spaced apart, so as to support between the guide-rail elements a log on the upper surface of the guide-rail elements, (iii) an air-draft deflector-brace element extending generally parallel to the entrance of the guide-rail elements, but angled away from such elements, and toward the combustion entrance when the door is in the opened position, so that, when the door is in the closed position, the draft-deflector element is positioned in the draft-air-flow path and deflects draft air coming into the elongated, slotted, draft-air opening downwardly into the combustion chamber, and (iv) the guide-rail elements having a log-slidable upper surface adapted to permit a log to be slid on the upper surface of the elements and generally parallel to the entrance to the combustion chamber, so as to position the log in a desired position for entry into the combustion chamber, and whereby, on placing the door in the upright closed position, the positioned log on the guide-rail elements is disposed into the combustion chamber of the stove.

4. The stove of claim 3 which comprises a draft-control means which includes an eccentric rod element and means to move the rod element between an opened and a closed position, whereby, by movement of the eccentric rod element between an opened and a closed position, the amount of draft air entering the elongated slot of the draft-control opening is controlled.

5. The stove of claim 3 wherein the door includes an angled draft-deflector element at the lower edge of the door in the opened position, two guide-rail elements spaced apart from each other on either side of the central axis of the door, the draft-deflector element, the guide rails and the door-brace element generally all parallel to each other and disposed in the plane of the door, and which includes end-brace elements extending generally perpendicular and secured at each end of the other elements.

6. A log-burning stove which comprises:

(a) a shell defining a combustion chamber for the combustion of logs;

(b) a flue for the discharge of gaseous combustion products derived from the combustion of the logs;

(c) an entrance in one wall of the shell and into the combustion chamber for the introduction of logs into the combustion chamber;

(d) a door adapted to be placed in an opened or a closed position, and which door, in the closed upright position, seals the entrance of the combustion chamber, and which, in the opened position, extends generally laterally outwardly adjacent to and from the lower bottom edge of the entrance of the combustion chamber;

(e) means to provide for the movement of the door between an opened and a closed position;

(f) an elongated slotted draft opening disposed in the front wall of the stove just below the bottom of the door and extending substantially the length of the door; and (g) the improvement which comprises means to permit a log positioned on the door to be moved directly into the combustion chamber through the combustion-chamber entrance, and which means comprises (i) a plurality of generally parallel, spaced-apart, fixed, guide-rail elements, the guide-rail elements in and extending slightly above the inner surface of the plane of the door and positioned and spaced apart so as to support between the guide-rail elements a log on the upper surface of the guide-rail elements, the guide-rail elements adapted to permit a log to be slid on its upper surface of the elements and generally parallel to the entrance to the combustion chamber, so as to position the log in a desired position for entry into the combustion chamber, and whereby, on placing the door in the upright, closed position, the positioned log on the guide-rail elements is disposed into the combustion chamber of the stove, (ii) an upper-door brace element extending above and generally parallel to the guide-rail elements, and (iii) a lower air-draft-deflector element extending below and generally parallel to the guide-rail elements, the deflector element angled downwardly, so that, when the door is in the closed position, the deflector element extends into the slotted opening of the draft opening and deflects draft air entering the draft opening downwardly into the combustion chamber.

7. The stove of claim 6 which comprises a draft-control means which includes an eccentric rod element and means to move the rod element between an opened and a closed position, whereby, by movement of theeccentric rod element between an opened and a closed position, the amount of draft air entering the elongated slot of the draft-control opening is controlled.

8. In a stove door used with a stove having a front-loading entrance to its combustion chamber and a draft which permits the flow of air into the combustion chamber, which draft comprises an elongated opening between the lower edge of the door and the lower edge of the entrance, the improvement which comprises an air-draft deflector/brace element extending generally parallel to the lower end of the door, but raised therefrom and angled toward the combustion entrance when the door is in the open position, so that, when the door is in the closed position, the draft deflector element is positioned in the draft-air-flow path and deflects draft air coming into the elongated draft-air opening downwardly into the combustion chamber.

* * * * *